US010104932B2

(12) United States Patent
Kim

(10) Patent No.: US 10,104,932 B2
(45) Date of Patent: Oct. 23, 2018

(54) SAFETY SHOES WITH A VENTILATION STRUCTURE

(71) Applicant: ZIBEN SAFETY CO., LTD., Bucheon-si, Gyeonggi-do (KR)

(72) Inventor: Deaho Kim, Bucheon-si (KR)

(73) Assignee: ZIBEN SAFETY CO., LTD., Bucheon-si (KR)

( * ) Notice: Subject to any disclaimer, the term of this patent is extended or adjusted under 35 U.S.C. 154(b) by 75 days.

(21) Appl. No.: 15/421,958

(22) Filed: Feb. 1, 2017

(65) Prior Publication Data

US 2018/0213884 A1 Aug. 2, 2018

(51) Int. Cl.

| | |
|---|---|
| ***A43B 7/08*** | (2006.01) |
| ***A43B 23/08*** | (2006.01) |
| ***A43B 7/12*** | (2006.01) |
| ***A43B 13/12*** | (2006.01) |
| ***A43B 13/04*** | (2006.01) |
| ***A43B 13/18*** | (2006.01) |

(52) U.S. Cl.

CPC ..... *A43B 7/085* (2013.01); *A43B 7/08* (2013.01); *A43B 7/12* (2013.01); *A43B 13/04* (2013.01); *A43B 13/12* (2013.01); *A43B 13/181* (2013.01); *A43B 13/187* (2013.01); *A43B 23/081* (2013.01); *A43B 23/082* (2013.01)

(58) Field of Classification Search

CPC .. A43B 7/06; A43B 7/08; A43B 7/084; A43B 7/085; A43B 23/08; A43B 23/081

USPC ..... 36/3 R, 3 A, 77 R, 77 M, 72 R

See application file for complete search history.

(56) References Cited

U.S. PATENT DOCUMENTS

| | | | | | |
|---|---|---|---|---|---|
| 1,383,905 | A | * | 7/1921 | Gates | A43C 13/14 36/72 R |
| 1,390,929 | A | * | 9/1921 | Saudino | A43B 7/06 36/3 R |
| 1,394,348 | A | * | 10/1921 | Pietrowski | A43B 7/06 36/3 A |
| 1,797,309 | A | * | 3/1931 | Wojciechowski | A43B 7/06 36/3 A |
| 1,890,433 | A | * | 12/1932 | Cohen | A43B 7/06 36/3 A |
| 1,946,986 | A | * | 2/1934 | Reed | A43B 7/06 36/3 A |
| 2,124,727 | A | * | 7/1938 | Bown | A43B 7/085 12/142 V |
| 2,125,798 | A | * | 8/1938 | McMurray | A43B 23/086 36/3 A |

(Continued)

FOREIGN PATENT DOCUMENTS

| | | | |
|---|---|---|---|
| KR | 200290572 | B1 | 10/2002 |
| KR | 1020050043537 | A | 5/2005 |

(Continued)

*Primary Examiner* — Marie Bays

(74) *Attorney, Agent, or Firm* — Finch & Maloney PLLC

(57) ABSTRACT

Safety shoes with a ventilation structure are provided. The safety shoes include a toecap on a front inner part, a plurality of longitudinal ventilation holes formed at one side of the toecap, an outer skin with an opening which laterally extends to overlap and communicate with the ventilation hole, the outer skin joined with an outer surface of the toecap, and an inner skin formed of a waterproof and breathable function material and joined with the inside of the opening. Thus, user's feet may be maintained always agreeably.

6 Claims, 7 Drawing Sheets

(56) References Cited

U.S. PATENT DOCUMENTS 2,191,906 A * 2/1940 Daniels ..... A43B 23/081 12/142 V
2,381,280 A * 8/1945 Handelsman ..... A43B 23/082 36/77 R
2,651,854 A * 9/1953 Taber ..... A43B 7/06 36/3 A
3,045,367 A * 7/1962 McKeon ..... A43C 13/14 36/72 R
4,693,021 A * 9/1987 Mazzarolo ..... A43B 7/08 36/131
4,995,174 A * 2/1991 Hong ..... A43C 13/14 36/72 R
5,171,033 A * 12/1992 Olson ..... A43B 5/1675 280/11.202
5,357,689 A * 10/1994 Awai ..... A43B 7/06 36/3 A
5,365,677 A * 11/1994 Dalhgren ..... A43B 1/04 36/3 A
5,551,172 A * 9/1996 Yu ..... A43B 7/10 36/3 A
8,479,411 B1 * 7/2013 Quinones ..... A43B 7/08 36/3 A
2001/0001903 A1 * 5/2001 Di Girolamo ..... A43B 7/06 36/3 R
2008/0052959 A1 * 3/2008 Hu ..... A43B 1/0081 36/42
2011/0185602 A1 * 8/2011 Kurth ..... A43B 1/0009 36/77 R
2016/0073727 A1 * 3/2016 Bier ..... A43B 1/04 36/3 R

FOREIGN PATENT DOCUMENTS

KR 1020090099348 B1 9/2009
KR 1020100015358 B1 2/2010
KR 1020110054958 A 5/2011
KR 1020130087344 A 8/2013
KR 2020140003097 A 5/2014

* cited by examiner

SAFETY SHOES WITH A VENTILATION STRUCTURE

BACKGROUND

1. Field

The inventive concepts relate to safety shoes and, more particularly, to safety shoes having a ventilation structure on which a detachable waterproof cover can be joined to make aquatic operation possible as well as which realizes effective ventilation and breathable functions by a ventilation hole which is directly formed at a toecap.

2. Description of the Related Art

Although there are various safety shoes depending on usage which is used at industrial fields, the safety shoes generally mean shoes which protect a foot from a heavy object dropping on a foot at a constructing site or a factory or which prevent a foot from getting hurt when the front portion of the foot is bumped into a very sharp or hard object during walk.

Particularly, the safety shoes used at a constructing site should have a very thick skin in order to prevent a foot from getting hurt by a heavy object falling on the foot, in order to absorb an impact or in order to reinforce the impact absorption from the heavy object. The thickness of the skin is provided in an industry safety regulation.

In addition, the outsole and the midsole should be thick in order to protect a foot from a sharp or pointed object on a floor. Therefore, the safety shoes are made by hard skin material to protect the foot safely in the entire structure. The outsole should be made by soft and pressure endurable material in order to consider thickness and provide activity, simultaneously.

As described above, the safety shoes should be very thick and the ventilation structure between an interior and an exterior of the safety shoes is very important. Korean laid registered utility No. 20-0447922 suggests safety shoes with ventilation function by forming an air hole passing to an interior.

However, this ventilation safety shoes are closed by toecap in its front part such that the ventilation structure has restrictions, it is difficult to maintain a user food agreeably because moisture permeates through the air hole at an upper side surface, and there is a problem that the safety shoes life is shortened because an inner skin was getting wet by permeated moisture and got mold and stank smell.

SUMMARY

Embodiments of the inventive concepts may provide safety shoes with a ventilation structure on which a detachable waterproof cover can be joined to make aquatic operation possible as well as which realizes effective ventilation and breathable functions by a ventilation hole which is directly formed at a toecap.

In an aspect, safety shoes according to embodiments of inventive concepts may include a toecap on a front inner part, and a plurality of longitudinal ventilation holes may be formed at one side of the toecap. An outer skin with an opening which laterally extends to overlap and communicate with the ventilation hole may be joined with the outer surface of the toecap. An inner skin formed of a waterproof and breathable function material may be joined with the inside of the opening.

BRIEF DESCRIPTION OF THE DRAWINGS

The inventive concepts will become more apparent in view of the attached drawings and accompanying detailed description.

DETAILED DESCRIPTION OF THE EMBODIMENTS

The inventive concepts will now be described more fully hereinafter with reference to the accompanying drawings, in which exemplary embodiments of the inventive concepts are shown.

Figure 1:
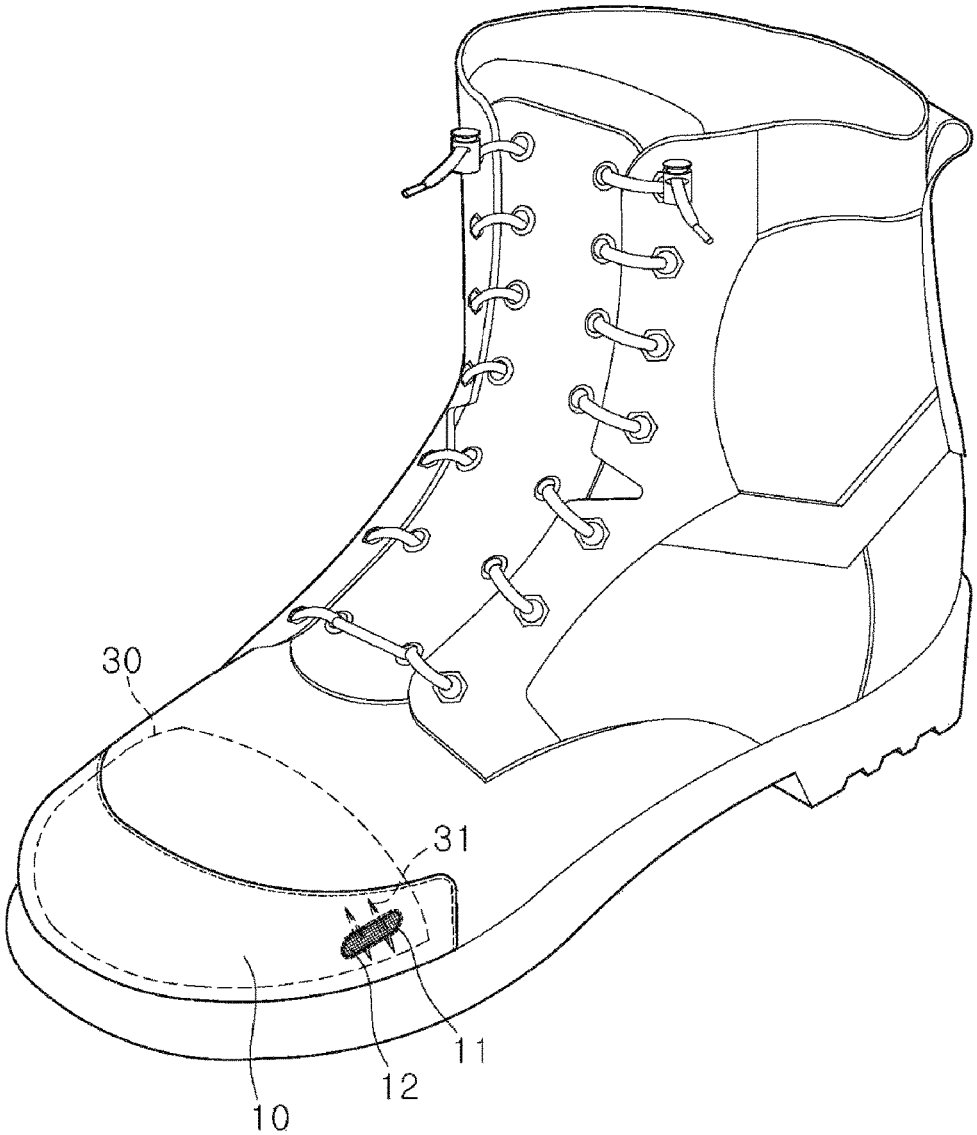
FIG. 1 is a perspective view illustrating ventilative safety shoes according to embodiments of the inventive concepts.

As shown in FIG. 1, safety shoes with a ventilation structure according to embodiments of the inventive concepts has an outer skin 10 sewn on a front part of the safety shoes, in which toes are located. Openings 11 are formed at both sides of the outer skin 10, respectively.

Fresh outer air may be passed into the interior of the safety shoes and warm inner air may be passed to the exterior through the opening 11, thereby maintaining user's foot agreeably even if the user wears the safety shoes for a long time.

A mesh 12 may cover the opening 11 to prevent stones or other foreign material from inflowing while the user wears the safety shoes at a working site.

Figure 2:
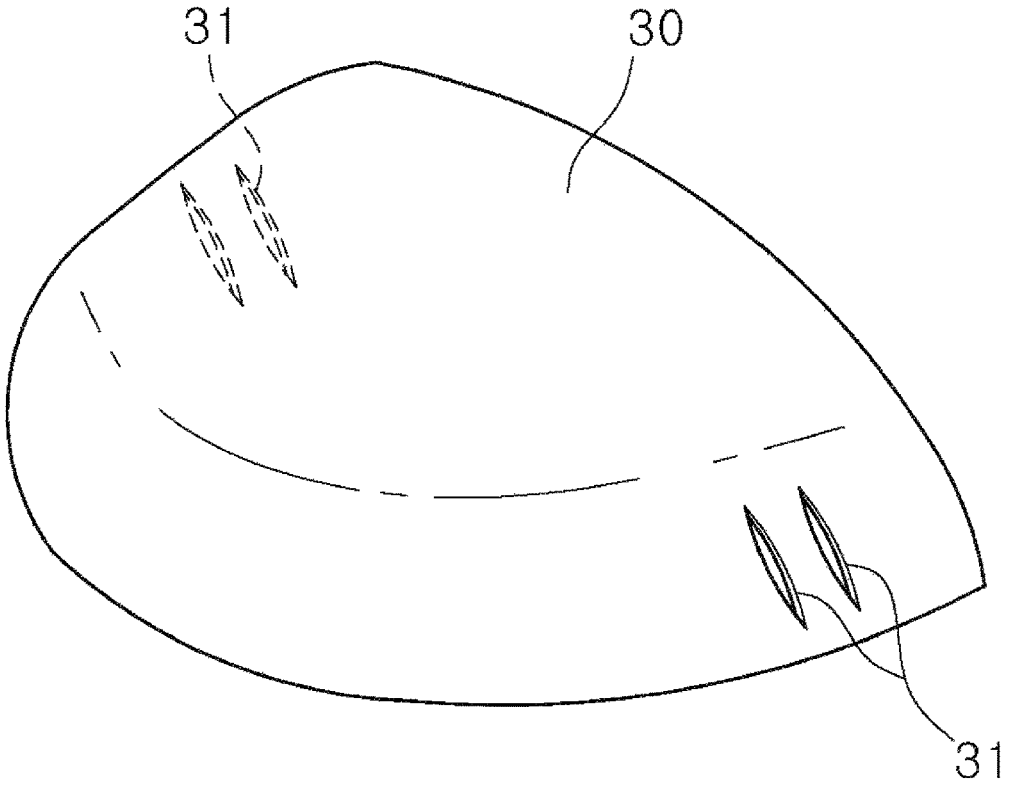
FIG. 2 is a perspective view illustrating a toecap according to embodiments of the inventive concepts.

In the inside of the safety shoes according to embodiments of the inventive concepts, a toecap 30 of metal material may be joined to protect user's toes, and a plurality of ventilation holes 31 as shown in FIG. 2 may be formed at both sides of the toecap 30.

The ventilation holes 31 may be formed at a location corresponding to the opening 11. In addition, the ventilation holes 31 may further be formed at a front side or an upper side of the toecaps 30 at need and the openings 11 may further be formed at the corresponding locations, thereby improving a ventilation function.

The ventilation holes 31 may be formed in a longitudinal shape, the opening 11 may be formed in a lateral shape. The ventilation hole 31 and the opening 11 may intersect each other, and overlapping central regions of the ventilation hole 31 and the opening 11 may be connected to each other. This structure may be provided to smoothly implement ventilation and breathable functions and to minimize influx of moisture and foreign material.

Figure 3:
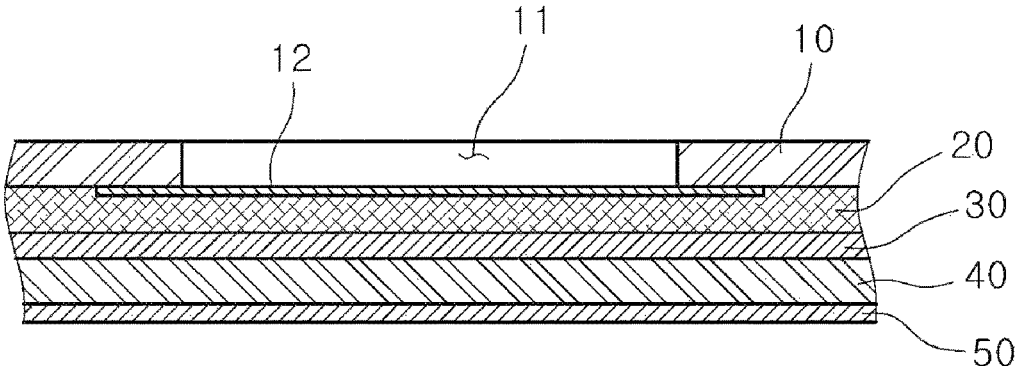
FIG. 3 is a cross-sectional view illustrating ventilative safety shoes according to embodiments of the inventive concepts.

For performing smooth ventilation function simultaneously with ventilating sweat from a foot to the exterior and for blocking an inflow of moisture, the front part of the ventilation safety shoes according to the embodiments of the inventive concepts may be formed of a multi-layered structure as shown in FIG. 3.

An outer skin 10 having a shape corresponding to the front part of the safety shoes may be joined to an outside of the front part of the safety shoes. The outer skin 10 may be formed of natural leather or artificial leather to protect the front part of the safety shoes which is worn easily, and the mesh 12 may be joined inside the opening 11 by sewing.

In addition, a non-woven fabric 20 may be joined inside the outer skin 10, the toecap 30 may be joined inside the non-woven fabric 20, and an elastic layer 40 may be joined inside the toecap 30 to protect the foot.

The elastic layer 40 may be formed of a sponge rubber which is a porous rubber with excellent elasticity. An inner skin 50 may be joined inside the elastic layer 40.

The inner skin 50 may be formed of a layered material in which a plurality of layers with functions of waterproof, moisture breath and/or windbreak is compressed. In some embodiments, the inner skin 50 may be formed of the N'CROTEX.

The safety shoes according to the inventive concepts may be formed to prevent an influx of water through the opening 11 even if the operation is implemented while the safety shoes is soaked in water for a long time, during operation in a puddle at a construction site or a valley of a mountain area.

Although the inner skin 50 with waterproof function is joined inside the opening 11, the inner skin 50 has a lifetime limitation as functional material. Thus, additional waterproof function may be necessary for operation with the safety shoes soaked in water for a long time.

Figure 4:
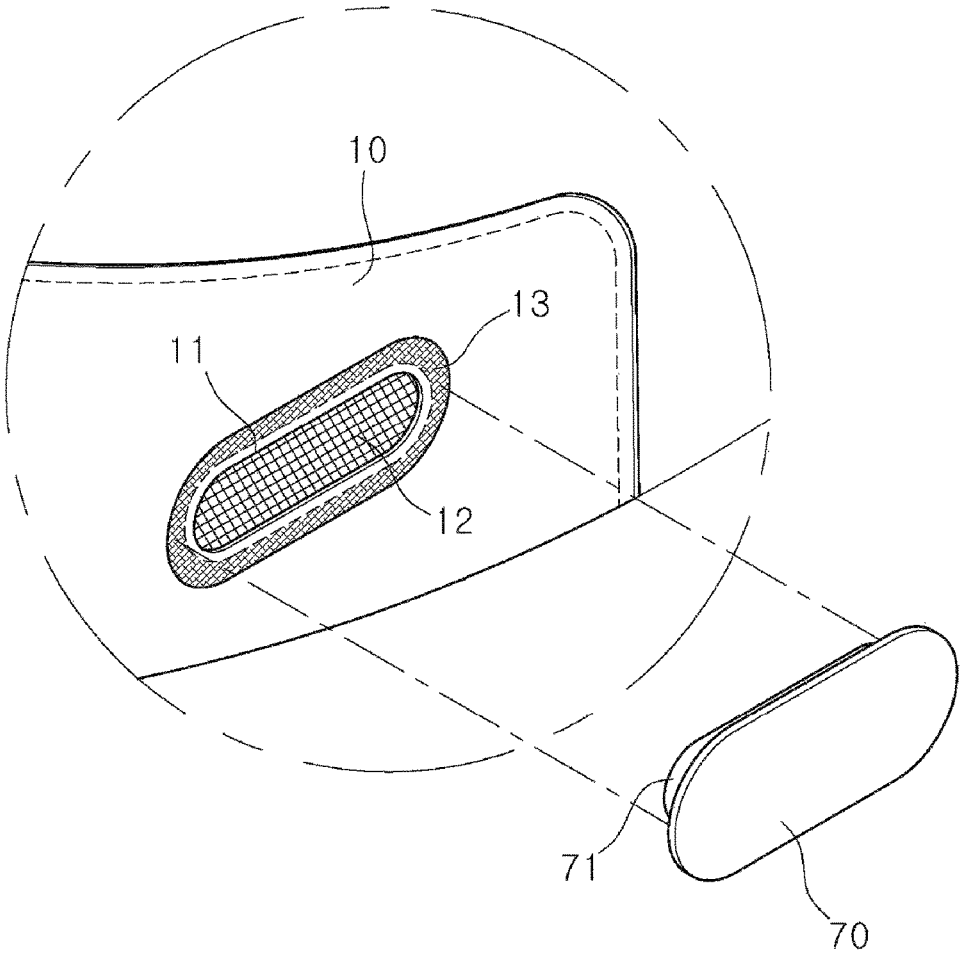
FIG. 4 is a perspective view illustrating a first embodiment of waterproof cover according to the inventive concept.

Thus, in an embodiment of the inventive concept, as shown in FIG. 4, a first waterproof cover 70 for closing the opening 11 may be provided to be detachable. As a result, convenience of working may be improved.

A hook-and-loop fastener, such as VELCRO® tape 13, may be coupled around the outside of the opening 11 in order to join the first waterproof cover 70 detachably. In addition, a first close contact portion 71 of a rubber material may be formed at the first waterproof cover 70 to be inserted in the opening 11 or attached around the opening 11 thereby preventing moisture influx.

Figure 5:
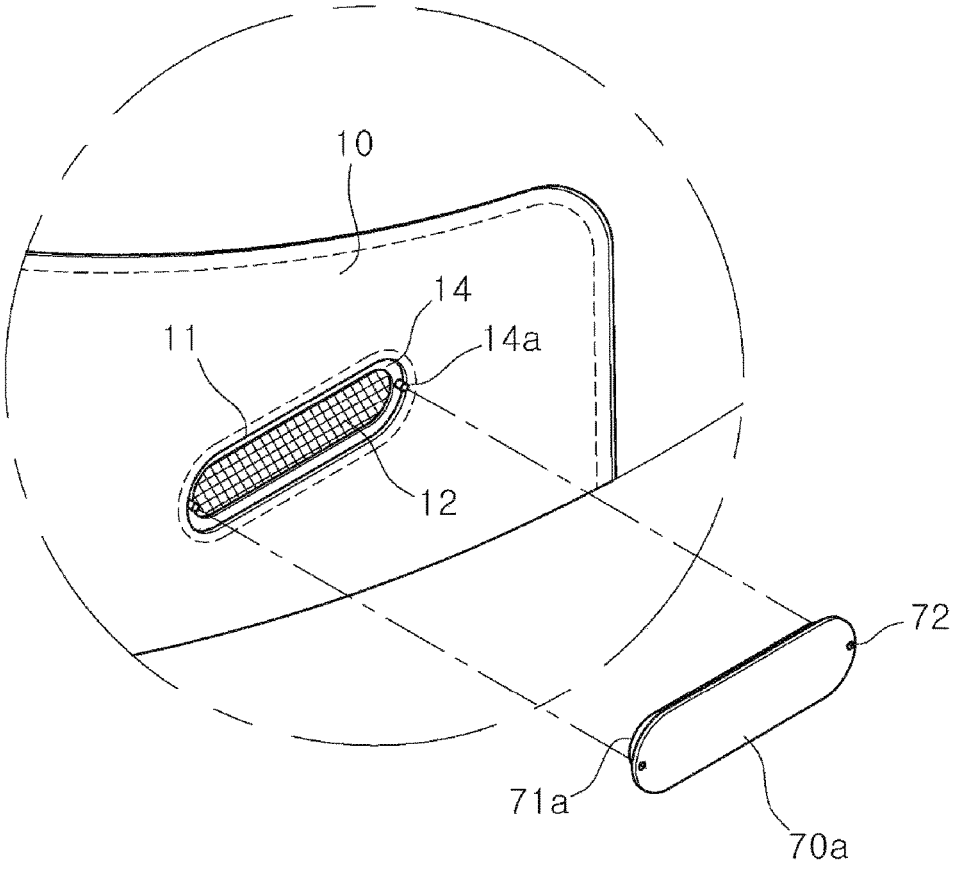
FIG. 5 is a perspective view illustrating a second embodiment of waterproof cover according to the inventive concept.

In another embodiment of the inventive concepts, as shown in FIG. 5, a coupling portion 14 may be sewn around the inside of the opening 11 to make a second waterproof cover 70*a* detachment convenience.

A coupling protrusion 14*a* may be formed at each side of the front surface of the coupling portion 14, and a coupling hole 72 in which the coupling protrusion 14*a* is inserted may be formed at the second waterproof cover 70*a*. Thus, the second close contact portion 71*a* may tightly close the opening 11.

Figure 6:
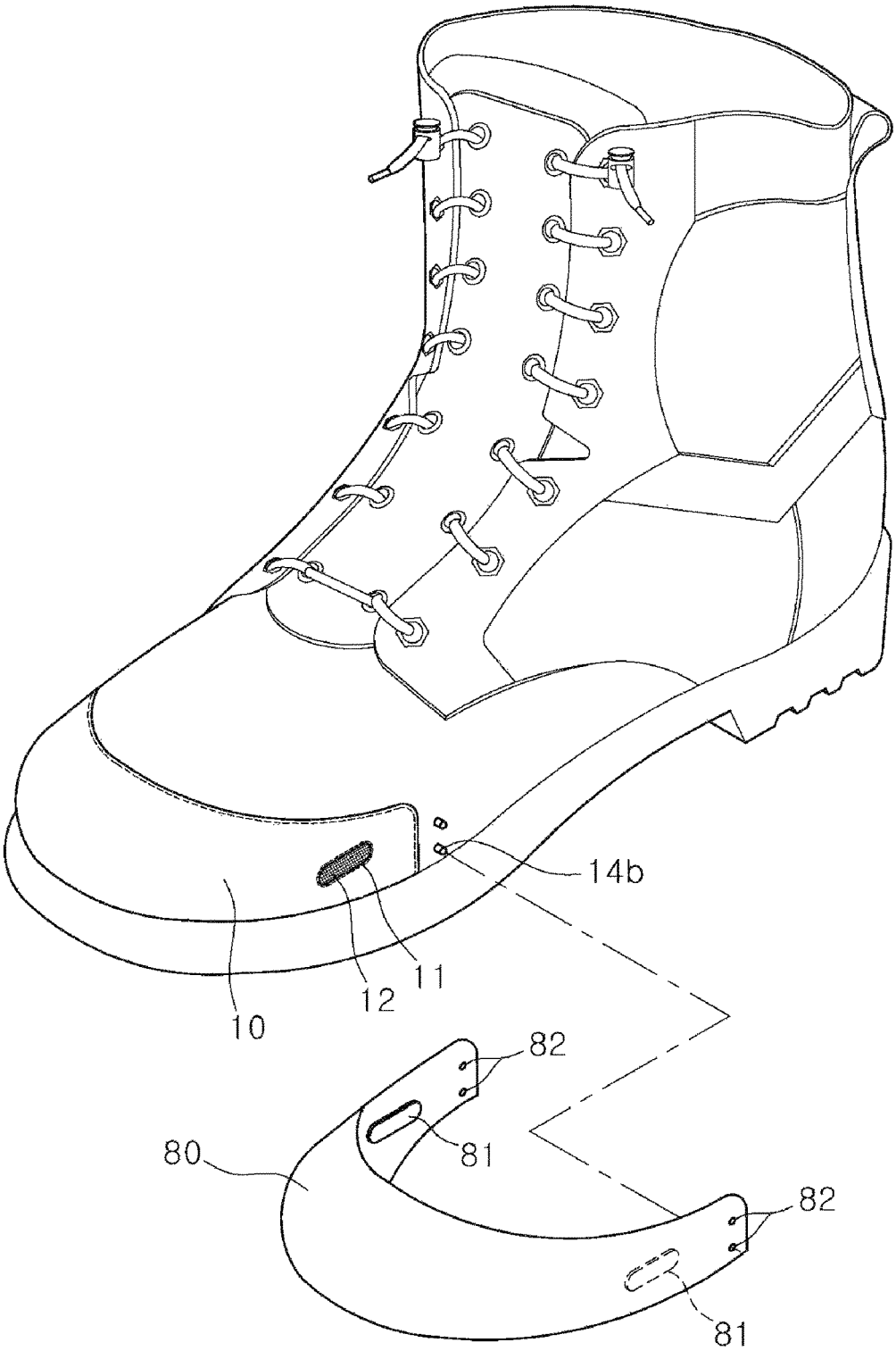
FIG. 6 is a perspective view illustrating a third embodiment of waterproof cover according to the inventive concept.

In still another embodiment of the inventive concept, as shown in FIG. 6, the opening 11 may be closed with a third waterproof cover 80 which is formed in a shape corresponding to the front part of the safety shoes to cover the upper side of the outer skin 10. In this case, the coupling portion 14 may be coupled to the inside of the safety shoes and a plurality of coupling protrusions 14*b* is provided to protrude from both sides of the safety shoes. Thus, the third waterproof cover 80 may be fastened at the front part of the safety shoes by using a plurality of coupling holes 82 formed at the third waterproof cover 80.

A third close contact portion 81 may be formed at inner surface of both sides of the third waterproof cover 80. The third close contact portion 81 may be formed at the location corresponding to the opening 11 to tightly close the opening 11 by elasticity.

Particularly, the coupling portion 14 with coupling protrusions 14*a* and 14*b* and the second and third waterproof covers 70*a* and 80 with coupling holes 72 and 82 may be formed of a thermoplastic poly urethane (TPU) material to enhance adhesion with each other. The TPU is flexible but is lighter and harder than silicon. Thus, the TPU is not fragile easily and is not covered with dust easily.

The safety shoes according to the inventive concepts has the inner skin 40 of a waterproof and breathable material as well as a plurality of openings 11 for ventilation at the front part to maintain user's feet agreeably.

In addition, the detachable waterproof covers 70, 70*a* and 80 are coupled to prevent the influx of water during operation in the water with the safety shoes.

According to embodiments of the inventive concepts, the safety shoes has the ventilation structure, a ventilation hole formed at the toecap which is joined in its front part, and a plurality of openings for ventilation which is formed at the outer skin covering its outside, thereby maintaining user's feet always agreeably. In addition, the inner skin of waterproof and breathable material is joined such that user's feet can be maintained always agreeably.

Furthermore, the detachable waterproof cover is coupled to block the influx of water influx during long time aquatic operation wearing the safety shoes, thereby obtaining effect of operation easiness.

Figure 7:
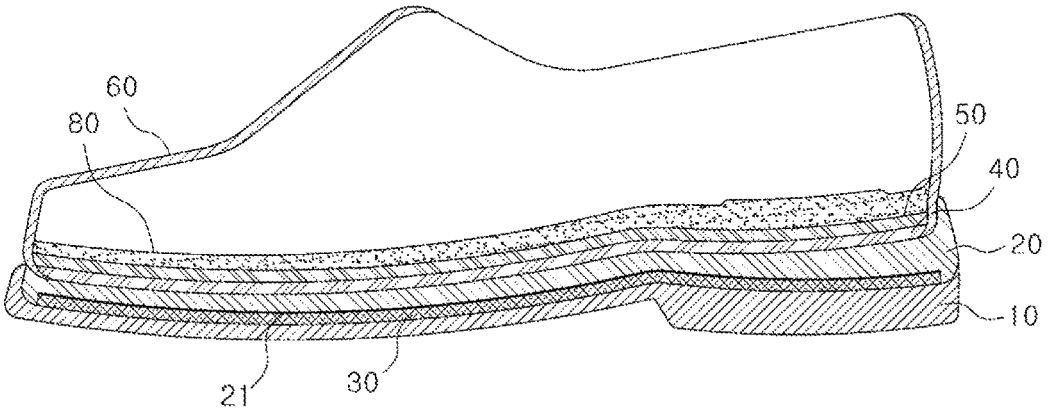
FIG. 7 is a cross-sectional view illustrating safety shoes according to embodiments of the inventive concepts.
Figure 8:
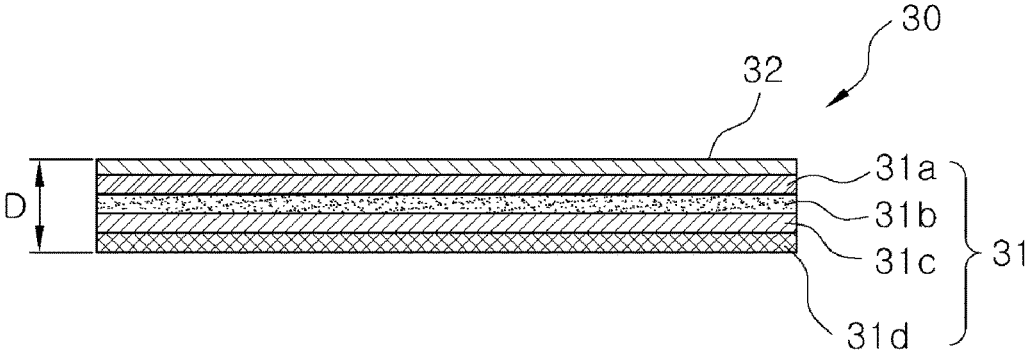
FIG. 8 is a cross-sectional view illustrating a bulletproof member inner plate in the FIG. 7.
Figure 9:
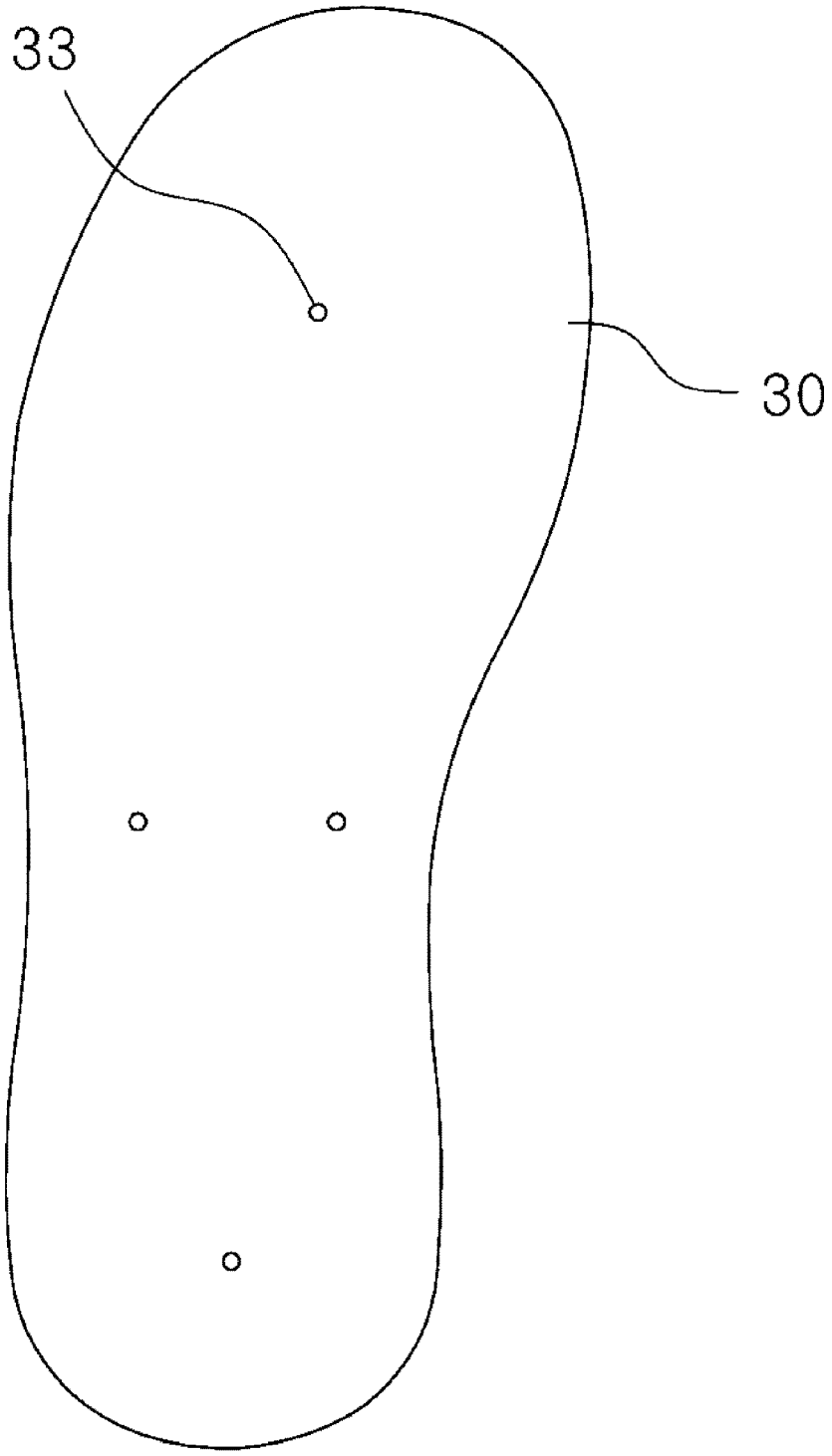
FIG. 9 is a front view illustrating the bulletproof member inner plate in the FIG. 7.

As shown in FIG. 7 to FIG. 9, the safety shoes are formed by sequentially arranging a lower sole 10, a bulletproofing member inner plate 30, a middle sole 20, a nonwoven fabric sole 40, and the upper sole 50.

The middle sole 20 for a safety shoes coupled between the lower sole 10 and the upper sole 50, the bulletproof member inner plate 30 is integrally coupled to the seating groove 23 formed at the lower side of the middle sole 20 by insert injection molding and the bulletproof member inner plate 30 is provided at one side thereof with an adhesive layer 21 coated with a thermosetting adhesive is formed so that the bulletproof member inner plate 30 can be firmly fixed to the seating groove 23. The middle sole 20 is made of a high temperature liquid phylon, the bulletproof member inner plate 30 is stretched by 10 to 20% in thickness and improved in strength due to shrinkage of the fibrous structure due to the high temperature of the middle sole 20.

The lower sole 10 is manufactured by mixing NBR (nitrile-butadiene rubber) 60%, which has high durability and is excellent in cushioning and shock absorption, and SBR (styrene butadiene rubber), which is excellent in wear resistance, aging resistance and heat resistance. The upper sole 50 is made of PU (polyurethane), which has an high elastic restoring force, and the middle pole 20 is made of Phylon, which has light and excellent in impact absorbing property.

A functional insole 80 is further provided on the upper side of the upper sole 50 in order to enhance the feeling of comfort when walking and to relieve fatigue and moisture of the feet.

The adhesive layer 21 uses a polyurethane adhesive among polyurethane resin adhesives which has adhesion strength strengthened by heating, and can be insert injection molded at high temperature.

In the bulletproof member inner plate 30, the fabric plate 32 is bonded to the upper side of the bulletproof material 31 manufactured by pressing the solid fibers to increase adhesion with the different materials.

The bulletproof material 31 is a product in which a plurality of bonded fiberboards 31*a* to 31*d* are closely coupled to each other so that nails cannot penetrate and has a certain thickness 'D' depending on how many layers are made.

A plurality of fixing holes 33 are formed at the bulletproof member inner plate 30 to prevent positional deformation during the insert injection molding, and the bulletproof member inner plate 30 is impregnated into a synthetic resin and dried in order to increase the strength. As the synthetic resin, any one of methyl methacrylate (MMA) unsaturated polyester, epoxy, and urethane is used.

The bulletproof member inner plate 30 is highly improved in strength in which the strength of the bulletproof member inner plate 30 is insert injection-molded integrally into the middle sole 20, and the shape of the bulletproof member inner plate 30 is maintained even if the shape of the shoe is deformed.

The bulletproof member inner plate 30 is integrally formed by insert injection molding on the inside of the middle sole 20, and the upper sole 50 or the inside sole 80 provided on the upper part is ergonomically formed so as to resemble the arch shape of the sole, so that a fit of the shoes is improved.

While the inventive concepts have been described with reference to exemplary embodiments, it will be apparent to those skilled in the art that various changes and modifications may be made without departing from the spirits and scopes of the inventive concepts. Therefore, it should be understood that the above embodiments are not limiting, but illustrative. Thus, the scopes of the inventive concepts are to be determined by the broadest permissible interpretation of the following claims and their equivalents, and shall not be restricted or limited by the foregoing description.

What is claimed is:

1. Safety shoes having a front part in which a toecap is provided, the safety shoes comprising:

a plurality of longitudinal ventilation holes formed at one side of the toecap;

an outer skin with an opening which laterally extends to overlap and communicate with the ventilation hole, the outer skin joined with an outer surface of the toecap; and an inner skin formed of a waterproof and breathable function material and joined with an inside of the opening.

2. The safety shoes of claim 1, wherein the opening is formed on the outer skin of which an inner surface is joined to a mesh, wherein a non-woven fabric is joined to an inner surface of the outer skin, wherein the toecap is joined to an inner surface of the non-woven fabric, wherein an elastic layer is joined on an inner surface of the toecap, and wherein the inner skin is joined on an inner surface of the elastic layer.

3. The safety shoes of claim 1, wherein one of first to third waterproof covers respectively having first to third close contact portions is detachably coupled with the opening to prevent an influx of water.

4. The safety shoes of claim 3, wherein the first waterproof cover is coupled to an upper side of the opening by a hook-and-loop fastener, wherein coupling holes formed at both sides of the second waterproof cover are coupled with coupling protrusions formed on both sides of a coupling portion, respectively, and wherein the third waterproof cover is formed to have a shape corresponding to a front side of the safety shoe such that coupling protrusions formed on both side of the outer skin are inserted into and coupled to coupling holes formed at both sides of the third waterproof cover.

5. The safety shoes of claim 3, wherein the coupling portion, the second waterproof cover and the third waterproof cover are formed of thermoplastic poly urethane (TPU) to increase adhesiveness.

6. The safety shoes of claim 4, wherein the coupling portion, the second waterproof cover and the third waterproof cover are formed of thermoplastic poly urethane (TPU) to increase adhesiveness.

* * * * *